US006112732A

United States Patent [19]

Larson

[11] Patent Number: 6,112,732

[45] Date of Patent: Sep. 5, 2000

[54] COMPOUND ARCHERY BOW

[75] Inventor: Marlow W. Larson, Ogden, Utah

[73] Assignee: Browning, Morgan, Utah

[21] Appl. No.: 09/326,473

[22] Filed: Jun. 4, 1999

Related U.S. Application Data

[63] Continuation of application No. 08/474,941, Jun. 7, 1995, Pat. No. 5,960,778.

[51] Int. Cl.[7] ..... F41B 5/10

[52] U.S. Cl. ..... 124/25.6; 124/900; 254/393; 474/169; 474/170

[58] Field of Search ..... 124/25.6, 86, 900; 254/390, 393; 474/168, 169, 170

[56] References Cited

U.S. PATENT DOCUMENTS

| | | | |
|---|---|---|---|
| 125,882 | 4/1872 | Clemons et al. | 474/169 X |
| 944,636 | 12/1909 | Rowlands et al. | 474/169 X |
| 992,901 | 5/1911 | Pipkin | 474/169 |
| 3,722,309 | 3/1973 | Shaffer | 474/169 |
| 4,337,749 | 7/1982 | Barna | 124/86 X |
| 4,365,611 | 12/1982 | Nishioka | 124/25.6 |
| 4,515,142 | 5/1985 | Nurney | 124/25.6 |
| 4,519,374 | 5/1985 | Miller | 124/25.6 |
| 4,957,094 | 9/1990 | Pickering et al. | 124/25.6 |
| 4,967,721 | 11/1990 | Larson | 124/25.6 |
| 5,040,520 | 8/1991 | Nurney | 124/25.6 |
| 5,368,006 | 11/1994 | McPherson | 124/25.6 |
| 5,505,185 | 4/1996 | Miller | 124/25.6 |
| 5,678,529 | 10/1997 | Larson | 124/25.6 |
| 5,809,982 | 9/1998 | McPherson | 124/25.6 |

*Primary Examiner*—John A. Ricci
*Attorney, Agent, or Firm*—Foster & Foster

[57] ABSTRACT

A compound bow carries eccentrics, each of which has a non-circular string groove with a geometric center removed from the axis of the eccentric and a take-up groove which is out of registration with the string groove about substantially the entire peripheries of the grooves. The two grooves are carried by respective sheaves rotatably joined through a hub which is itself rotatably connected to one of the sheaves. Other aspects of the present invention relate to a unique idler used in combination with a single-cam embodiment of the present invention.

30 Claims, 13 Drawing Sheets

COMPOUND ARCHERY BOW

RELATED PATENT APPLICATIONS

This is a continuation of U.S. patent application Ser. No. 08/474,941, filed Jun. 7, 1995, now U.S. Pat. No. 5,960,778.

This application discloses inventions which are related to inventions of this inventor disclosed in Ser. No. 738,569, filed Jul. 31, 1991; and U.S. Pat. Nos. 5,054,462; 5,020,507; 4,748,962; 4,774,927 and 4,686,955.

The disclosures of each of these related patents and patent application are incorporated as a portion of this disclosure for their respective teachings concerning the design of leveraging components for compound archery bows and the incorporation of such leveraging components into functioning compound bows.

BACKGROUND

1. Field

This invention pertains to compound archery bows and in particular to the leveraging components for such bows. It specifically provides improved compound bow constructions, including improved pulley or wheel members.

2. State of the Art

Compound archery bows have been well known for many years. An early patent descriptive of such bows and their mode of operation is U.S. Pat. No. 3,486,495. Such bows are generally characterized by "let-off" leveraging devices carried at the distal ends of the limbs. These leveraging devices are usually referred to as wheels or pulleys, although they may take various forms, including some with other than circular cross-sections. They are commonly referred to as "eccentrics," because they characteristically are pivoted around an axle located off center with respect to their perimeters.

Archery bows of the type commonly known as "compound bows" are generally characterized by a pair of flexible limbs extending from opposite ends of a handle. The tips of the limbs are thus spaced apart in relationship to each other in a fashion similar to the limb tips of a traditional stick bow. The limbs are deflected by the operation of a bowstring in the same fashion as a traditional bow, but the bowstring is interconnected to the limbs through a rigging system including mechanical advantage-varying structures (including those commonly referred to as "eccentrics") and tension runs which transfer a multiple of the bowstring tension to the respective limbs. Tension runs are interchangeably and loosely referred to by those skilled in the art as "cables," "cable stretches," "bow string end stretches" and "end stretches." In any event, the rigging system may be regarded as a specialized block and tackle arrangement whereby pulling force applied to the bowstring is transferred to the limb tips to flex the limbs. The bowstring and tension runs may comprise a single continuous loop but, more typically, the bowstring is constructed of special bowstring material, while the tension runs are of more rugged construction, e.g. as from aircraft cable. The bowstring and tension runs together are referred to interchangeably as the "cable system," "cable loop" or "rigging loop."

The rigging of a compound bow functions as a block and tackle to provide a mechanical advantage between the force applied to the bowstring by an archer and the force applied to the bow limbs. In other words, in operation, the nocking point of the bowstring is moved a longer distance than the total distance that the two limb tips move from their braced position. Although other configurations are possible, an eccentric is usually pivotally mounted at each limb tip. If the eccentrics are mounted elsewhere, the rigging usually includes a concentric pulley at each limb tip. In some instances, a single pulley may carry concentric and eccentric tracks.

Each eccentric has grooves or tracks analogous to the pulley grooves in a traditional block. A string track is arranged alternately to pay out or take up string as the limbs are alternately flexed to drawn or relaxed to braced condition. A cable track is arranged alternately to take up portions of the tension run as string is paid out while the eccentric pivots to drawn condition and to pay out portions of the tension run as string is wound onto the string track while the eccentric pivots to braced condition.

For purposes of this disclosure, it is recognized that in the operation of a compound bow, the portion of the rigging called the bowstring actually lengthens as the string is pulled back because as the eccentrics pivot from their braced condition, portions of the bowstring stored in the string tracks unwind and are paid out. Concurrently, portions of the tension run are wound onto the cable tracks of the eccentrics so that the tension runs decrease in length. The opposite phenomenon occurs as the string is released, permitting the eccentrics to pivot back to their braced condition. Assuming that the eccentrics are carried by the respective limbtips, the portion of the rigging loop extending between points of tangency of the bowstring with the string track of the eccentrics will be referred to herein as the "central stretch" of the bowstring. The bowstring shall be considered to include, in addition to the central stretch, portions of the rigging loop stored at any time in association with the string tracks of the eccentrics. The portions of the rigging loop extending from the points of tangency of the tension stretches with the cable tracks of the eccentrics to remote points of attachment to the bow shall be called "end stretches." Each tension run is considered to include, in addition to an end stretch, the portion of the rigging loop extending from the end stretch and wrapped within or otherwise stored in association with the cable track of the associated eccentric.

SUMMARY OF THE INVENTION

The present invention provides a number of improvements to the construction of compound bows. A notable such improvement is in the construction of pulley members, especially leveraging components structured as eccentric members. Ideally, the improved eccentric of this invention is embodied as a wheel incorporating a novel step-down take-up cable ramp. That ramp may be adjustably associated with a payout portion of the eccentric to permit selection of the course of the cam ratio developed by the eccentric in operation.

The step-down take-up feature of this invention combines the desirable features of a side-by-side pulley system and a step-down pulley system. It may also be embodied to significantly reduce the bending moment of the bow limbs at full draw while providing for adequate vane clearance when an arrow is launched. According to such embodiments, when the bow is at static or undrawn condition, the draw string is taut and pulls on the pulley or eccentric with more force than is applied by the cable wound on the take-up side of the eccentric. In that position, the string or central stretch end of the cable is positioned in a groove at one side of the eccentric and the take-up end of the cable is positioned within a groove on the opposite side of the eccentric, thereby maintaining any differential in forces within tolerable limits; that is, any resulting bending moment is of low magnitude, and does not materially affect the limb. As the eccentric pivots in response to pulling on the bowstring, the wound end of the cable is cammed from its static rest position down a ramp towards the center of the eccentric, thereby carrying the force plane of the cable towards the center of the axle. As the cable travels down the ramp, the effective diameter of the eccentric (the cable lever arm) decreases. Thus, the eccentric assumes the characteristics of a step-down pulley with a reduced ratio at full draw. At full draw, the forces in the cables are at their maximums, and it is a significant advantage for those forces to be applied near the centers of the axles. When an arrow is launched, the wound cable unwinds moving the wound end up the ramp, thereby increasing the ratio of the eccentric. The speed of the arrow is thus increased, as in the case of a side-by-side eccentric.

The present invention provides an improved eccentric element for the rigging system of "compound bows." The eccentrics of this invention may be used in place of more conventional eccentrics in any of the various configurations of compound bows heretofore known in the archery art. They are also useful in so-called "single cam bows" in which either the upper or lower wheel element is concentric or nearly concentric in operation.

The principles of operation of this invention may be understood and are conveniently described with reference to the compound bow arrangement traditionally most prevalent; that is, a bow in which a pair of resilient limbs are deflected by the operation of a bowstring interconnected to the distal ends (or tips) of the limbs through a three-line lacing (rigging) including an eccentric of this invention pivotally mounted at each limb tip. The eccentrics may be referred to as the "upper eccentric" and "lower eccentric," respectively, having reference to their relative positioning when the handle of the bow is grasped by the archer in a normal shooting position. (That is, with the limbs held approximately vertically.)

According to this invention, the upper eccentric may be a reverse ("mirror image") of the lower eccentric. Alternatively, either or both the upper or lower eccentric may be replaced with a concentric wheel having either or both concentric or eccentric winding and/or unwinding tracks.

In traditional compound bows, each eccentric typically includes two sheave portions. The first portion accommodates one end of the bowstring or central stretch in a bowstring-engaging track which is usually of non-circular configuration. The second portion accommodates a tension run or end stretch in a tension-engaging track which is usually also of non-circular configuration. The two sheave portions are of different configurations; that is, their perimeters are out of registration with each other. The first and second tracks are arranged with respect to each other to effect a varying "cam ratio" between the points of tangency of the central stretch and the end stretch with the eccentric. That is, the distances between the axis of the eccentric and the respective points of tangency vary as the eccentric pivots on its axis in response to pulling of the bowstring. The cam ratio of the eccentric may be defined as the ratio of the perpendicular distance between the axis of the eccentric and the point of tangency of the bowstring divided by the perpendicular distance between said axis and the point of tangency of the end stretch. The larger the cam ratio, the greater the mechanical advantage effected through the eccentric.

The step-down take-up cable ramp described in the aforesaid U.S. Pat. No. 4,748,962 is incorporated in the eccentric of the present invention. This ramp functions to move the portion of the tension run adjacent the cable track down towards the axis of the eccentric as the eccentric pivots toward its drawn condition. As the eccentrics are permitted to pivot back towards braced condition (the drawn bowstring is released), this portion of the tension run is carried back away from the axis of the eccentric.

The eccentrics of this invention may be relatively narrow. This narrowness assists in concentrating the forces applied by the rigging near the midline of the bow limbs, contributing to the stability of the system.

The runs of the rigging may be anchored to the eccentrics by means of a single screw pressing on a run through the center of the eccentrics. This system provides for infinite adjustment (between finite limits; e.g., 28 to 30 inches) of draw length. In other embodiments, the range of finite limits may be increased to five or more inches by incorporating greater degrees of freedom in the adjustments incorporated in the eccentric (or wheel) structure.

The shape of the force-draw curves which can be developed through the use of eccentrics of this invention offer several advantages. The initial slope of the force-draw curve can be made very steep, and the let-off of pulling force characteristic of compound bows generally can be caused to occur very near full draw. Accordingly, substantially more available energy may be stored in the limbs of the bow with the eccentrics of this invention as compared to eccentrics of the prior art.

A typical compound bow of this invention carries eccentrics, each of which has a non-circular string groove with a geometric center removed from the axis of the eccentric and a take-up groove which is out of registration with the string groove about substantially the entire peripheries of the grooves. The two grooves are preferably carried by respective sheaves rotatably joined through a hub which is itself rotatably connected to one of the sheaves. The take up groove may be associated with the hub generally as disclosed by the aforesaid U.S. Pat. Nos. 4,686,955 and 4,774,927, the disclosures of which are incorporated as part of this disclosure for their respective teachings concerning the mounting of a take-up segment to rotate on a hub carried by a string segment of an eccentric.

BRIEF DESCRIPTION OF THE DRAWINGS

In the drawings, which illustrate what is currently regarded as the best mode for carrying out the invention.

DESCRIPTION OF THE ILLUSTRATED EMBODIMENTS

Figure 2:
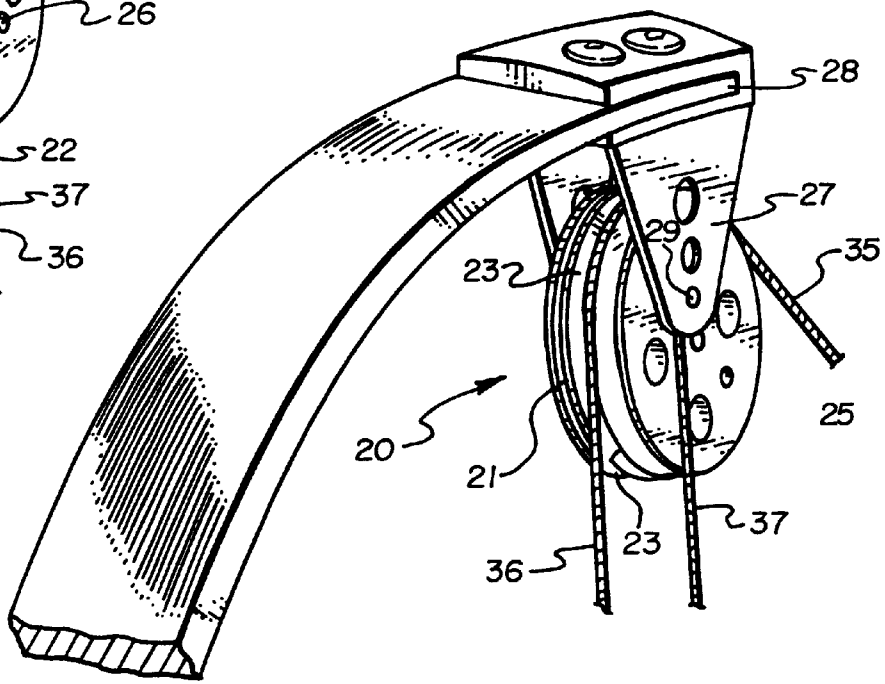
FIG. 2 is a view similar to FIG. 1 but showing the limb and eccentric in full draw condition.
Figure 1:
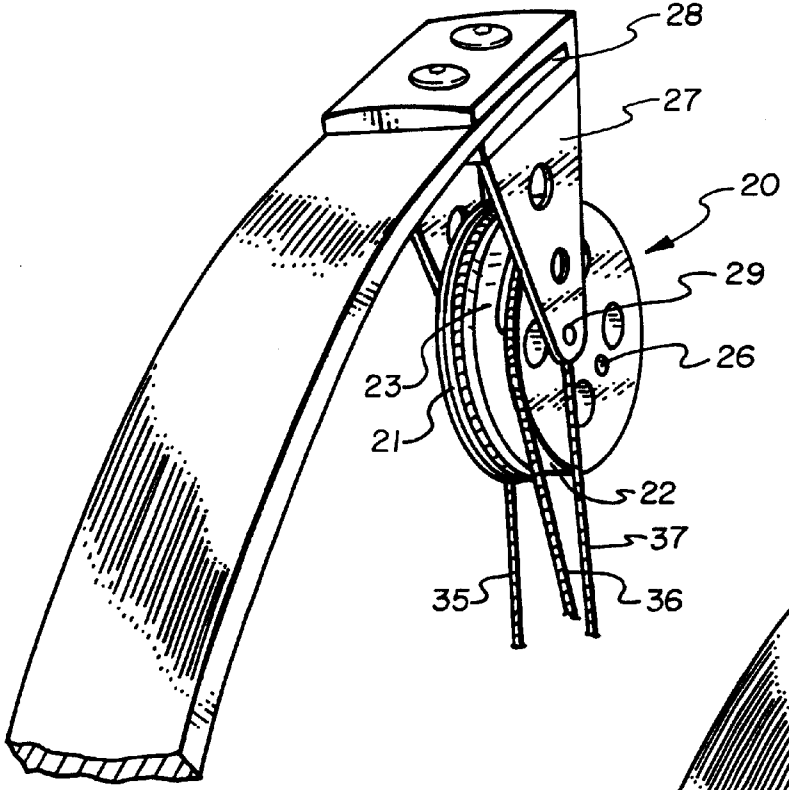
FIG. 1 is a pictorial view of a portion of a compound bow limb with an eccentric of the type described by U.S. Pat. No. 4,748,962 mounted to its distal end shown in at rest condition.

The eccentric wheel 20 of FIGS. 1 and 2 is relatively wide, typically approximately ¾ inch, and is of the "side-by-side" type. That is, it carries a string groove 21 at one edge and a take-up groove 22 at its opposite edge. The draw side groove 22 merges into ramp 23 which functions to cam the cable lying in that groove either towards the center or the edge of the wheel 20 depending upon the direction of rotation of the wheel 20. The specific eccentric 20 illustrated is for the upper limb. A corresponding eccentric for the lower limb is similar in all essential details, but the ramp 23 is configured to wind and unwind in directions opposite those of the illustrated eccentric 20. This disclosure is directed to the upper eccentric 20 illustrated to avoid redundancy.

As illustrated, the wheel 20 includes a pair of journals 25, 26 from which the wheel 20 may selectively be mounted to a hanger structure 27 carried by the distal end of the limb 28 by means of an axle bolt 29. The grooves 21, 22 are connected by an interior bore (not shown) which runs diagonally through the wheel 20.

As best shown by FIG. 1, in the at rest (static, or brace) condition, the eccentric 20 is positioned so that the strung end 35 of the cable is contained by the groove 21 at one side of the eccentric 20 and the wound end 36 of the cable is contained by the groove 22 at the opposite side of the eccentric 20. The anchored end 37 of the other cable of the system is attached to the axle bolt 29 opposite the string groove 21. In this position, the forces applied by the two cable ends 36, 37 approximately balance the force applied by the string end 35. FIG. 2 shows the eccentric 20 pivoted at full draw so that the wound end 36 has cammed down the ramp 23. In this position, the force applied by the wound end 36 is much increased, but is applied near the midpoint of the axle 29. The torque resulting from the strung end 35 approximately balances the torque resulting from the anchored end 37. The vane clearance remains adequate (in the illustrated instance, approximately ½ inch). The ratio developed through the eccentric in FIG. 2 is greater than the corresponding ratio in FIG. 1, but less than in a conventional side-by-side eccentric.

It is within contemplation that the take-up groove 22 and the ramped surface 23 be coplanar. For example, the take-up groove may be made progressively deeper or the diameter of the eccentric carrying the take-up groove may be made continuously smaller in the direction of the wind. In either event, the ratio at full draw will be relatively low (compared to a side-by-side eccentric), and will approach the conventional side-by-side ratio as the eccentric returns to static condition. A bow may be constructed so that the torque forces on the limbs are either approximately balanced or are within tolerable limits at full draw, even though the cable is cammed only downward, and not also toward the midpoint of the axle. It is also within contemplation that the cable may be severed and segments of the cable separately attached to the eccentric to train in the string groove and take-up groove, respectively. Such segments are still considered parts of a single cable within the context of this disclosure and the appended claims.

Figure 3:
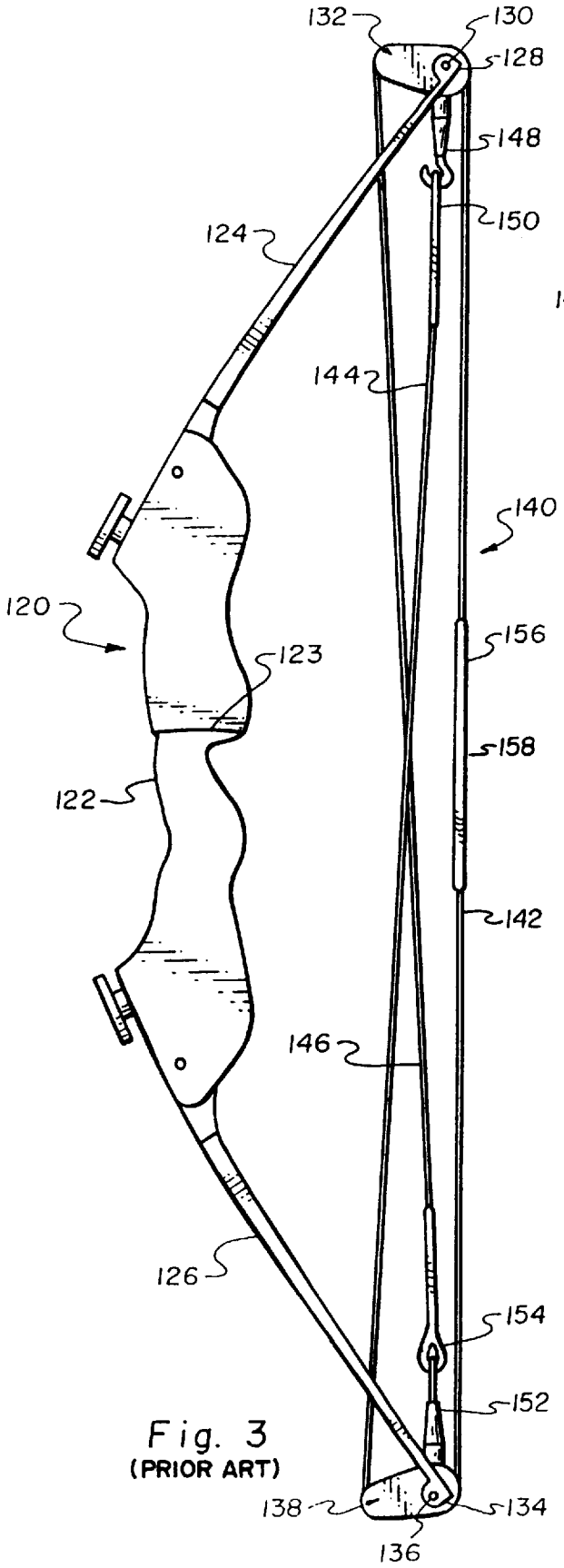
Fig. 3 (PRIOR ART)
FIG. 3 is a side elevational view of a compound archery bow carrying non-circular eccentrics of the type described by U.S. Pat. No. 3,486,495 with an elliptical string track.
Figure 5:
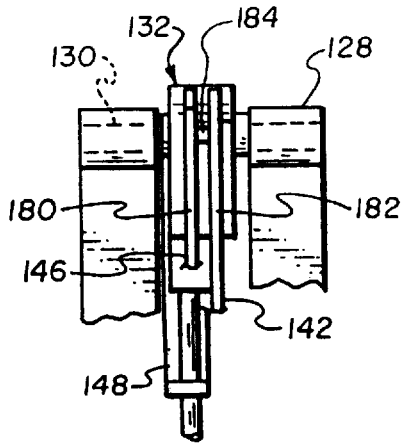
Fig. 5 (PRIOR ART)
FIG. 5 is a front view of the structure shown in FIG. 4.

FIG. 3 illustrates a bow 120 provided with a riser or handle section 122 having an arrow shelf 123 and a pair of upper and lower limbs 124 and 126, respectively, extending outwardly therefrom. Upper limb 124 has a tip 128 which is bifurcated as illustrated in FIG. 5 and mounts a cross pin 130 upon which an eccentric pulley member 132 is rotatably mounted. Similarly, lower limb 126 has a bifurcated tip 134 which carries a cross pin 136 upon which a pulley member 138 is eccentrically mounted.

A bowstring 140 is trained around members 132 and 138 to present a central stretch 142 and a pair of end stretches 144 and 146. An adjustable coupling 148 connects the end 150 of stretch 144 to tip 128 at cross pin 130, an adjustable coupling 152 connecting end 154 of stretch 146 to tip 134 at cross pin 136. The central, outer stretch 142 is provided with a serving 156 which presents the nocking point 158 of the bowstring.

Figure 4:
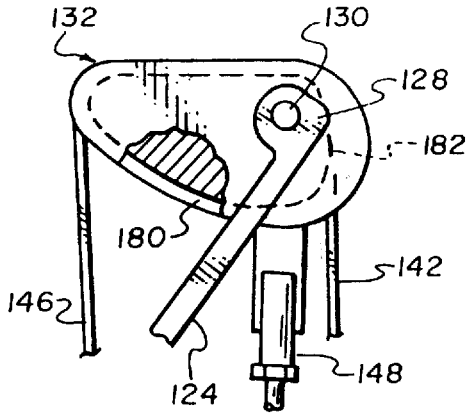
Fig. 4 (PRIOR ART)
FIG. 4 is an enlarged detail of the upper eccentric shown by FIG. 3 illustrating internal surfaces by phantom lines.

Member 132 is of generally oval-shaped configuration and is grooved (see FIG. 6) to present a pair of parallel bowstring tracks 180 and 182 which traverse a generally oval-shaped course. Track 182 at the right band edge of member 132 (as viewed in FIGS. 5 and 6) is more deeply recessed into the periphery of the member than track 180, and thus is shorter in length. Stretch 146, when the bow is at rest as shown in FIG. 3, contacts track 180 at the left end of member 132 (as viewed in FIGS. 4 and 6) and then the bowstring makes approximately a two-thirds wrap before crossing over to track 182. Then, the bowstring follows track 182 for approximately a three-quarter wrap and emanates from device 132 to present central stretch 142. Crossover of the bowstring from track 182 to track 180 is permitted by a notch 184 in the periphery of member 132 which intercommunicates the two tracks.

Figure 6:
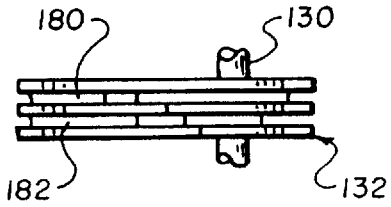
Fig. 6 (PRIOR ART)
FIG. 6 is as plan view of the structure shown in FIG. 4.

Member 138 is identical in construction to member 132 except that the tracks therein are reversed with respect to the showing of FIG. 6 to dispose the shorter track of member 138 in the same plane as track 182 of member 132, and the longer track thereof in the same plane as track 180.

Figure 7:
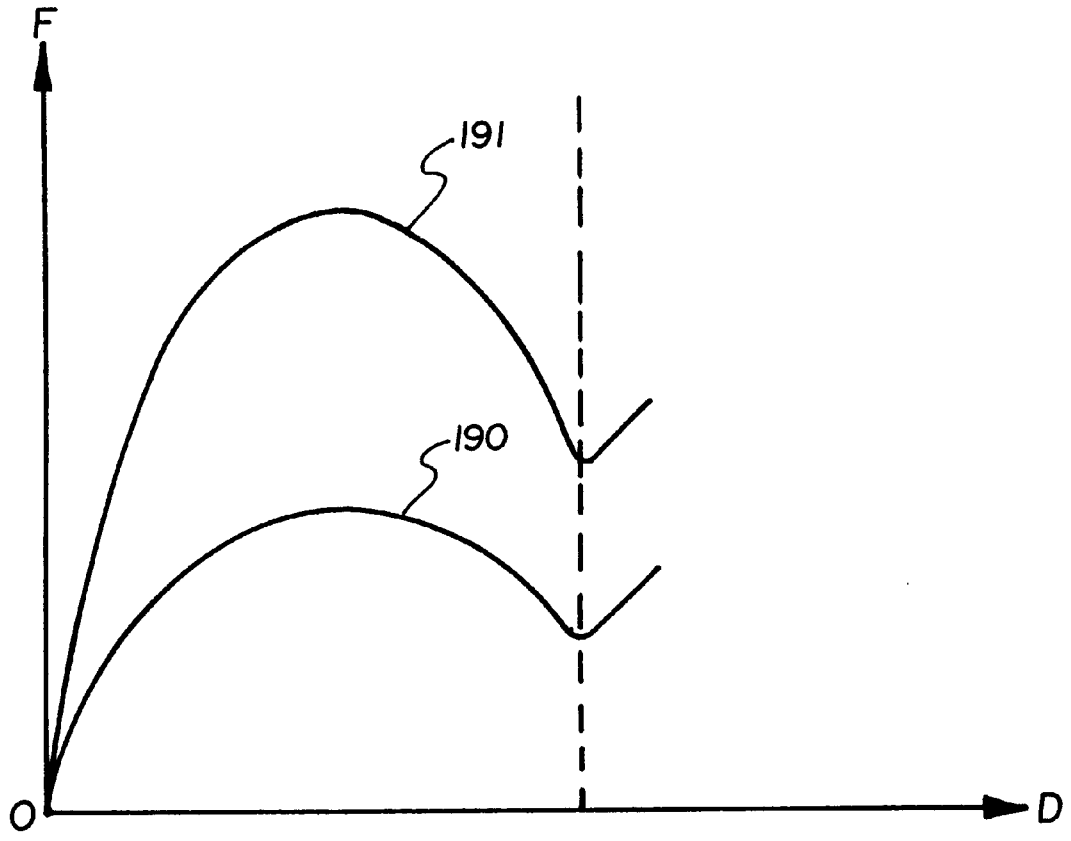
FIG. 7 is a theoretical graph of holding force versus drawn distance characteristic of the bow illustrated by FIG. 3.

FIG. 7 illustrates the operation of the bow illustrated by FIG. 3 as explained in the aforesaid U.S. Pat. No. 3,486,495, the disclosure of which is incorporated by reference. The ordinate axis of the graph is labeled "D" and indicates the distance that nocking point 158 is drawn from its at-rest position. The abscissa axis, designated "F," indicates the force required to hold the nocking point 158 at any drawn distance "D." One-half the force applied to the nocking point 158 by the archer (the amount distributed to each eccentric member 132, 138) is plotted as curve 190. The total force applied to the nocking point 158 is plotted as curve 191 in accordance with conventional practice. Plots such as 190 and 191 are commonly called "force draw curves," "force curves," or "draw force curves."

Figure 8:
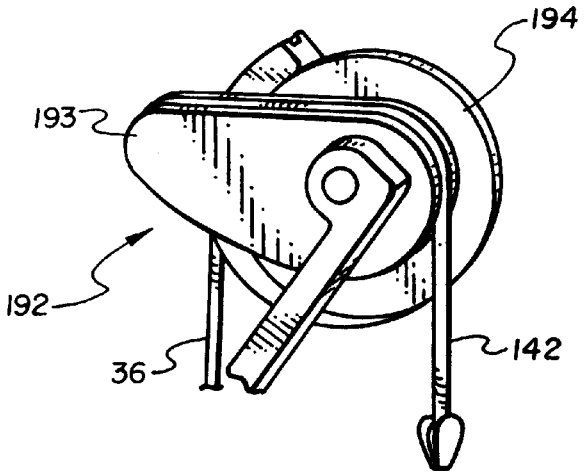
FIG. 8 is a pictorial view, illustrating internal surfaces by phantom lines, of an eccentric combining the take-up cable groove of the eccentric of FIGS. 1 and 2 with the elliptical string track of the eccentric of FIGS. 3 through 7.
Figure 9:
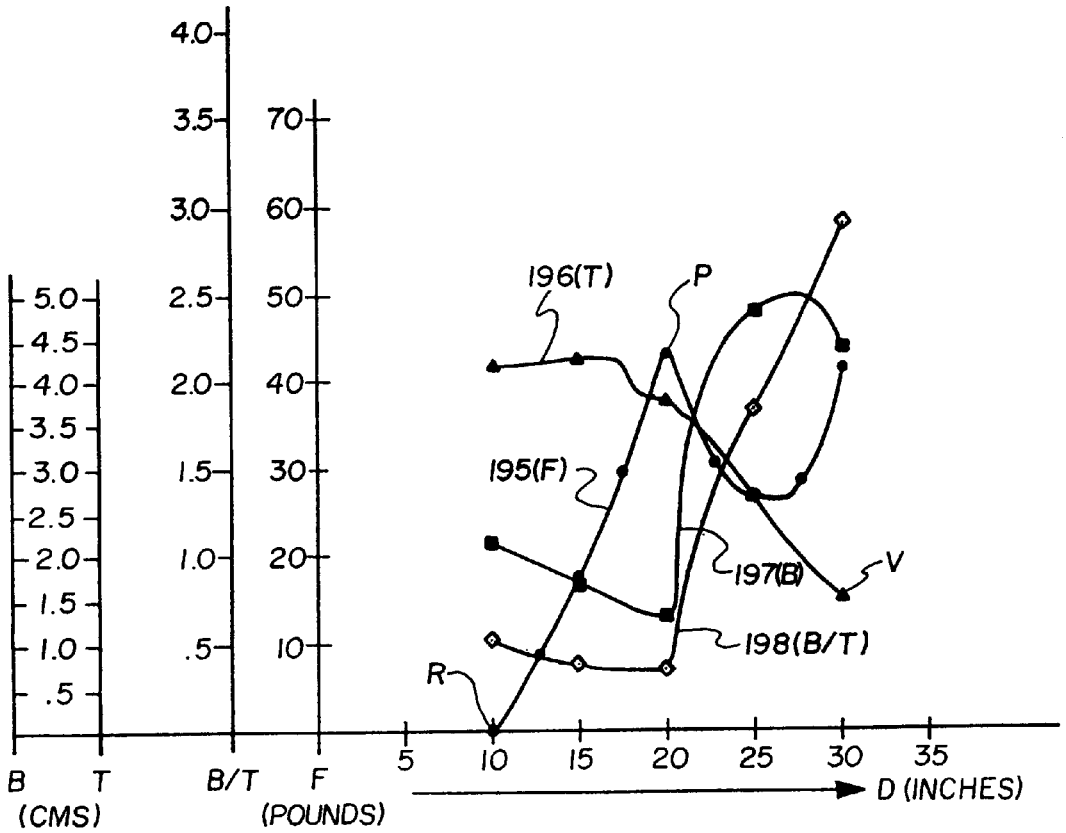
FIG. 9 is a graphical representation of a force draw curve of a bow similar to that illustrated by FIG. 3 with eccentrics as illustrated by FIG. 8, the draw distance also being correlated to certain characteristics of the eccentrics.

FIG. 8 illustrates an eccentric 192 which is structured by combining an elliptical string track 193 similar to the track 182 (FIG. 6) with a cable track 194 similar to the groove 22 and ramp 23 (FIGS. 1 and 2). FIG. 9 plots a force draw curve 195 (F) characteristic of a bow such as that illustrated by FIG. 3 carrying eccentrics of the structure illustrated by FIG. 8 (the lower eccentric being a mirror image of the eccentric 192). Other geometric characteristics of the eccentric 192 as a function of draw length "D" are also plotted as curves 196(T), 197(B), and 198(B/T), respectively.

Figure 10:
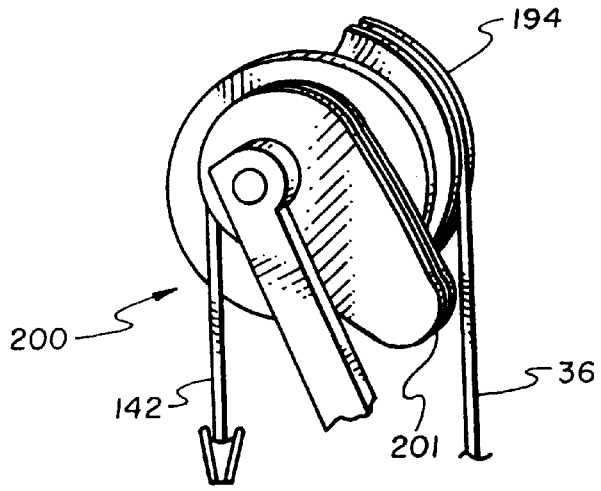
FIG. 10 is a view similar to FIG. 8 of an alternative eccentric of the same type.
Figure 11:
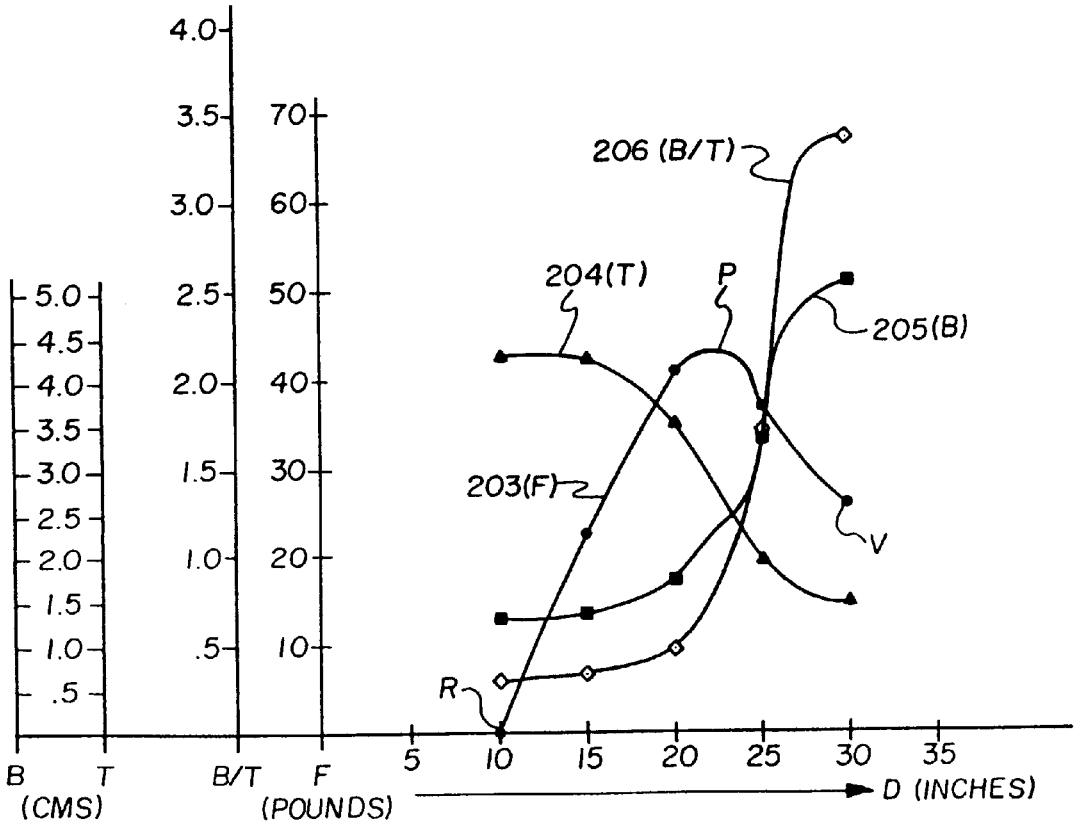
FIG. 11 is a graphical representation similar to FIG. 9 pertinent to a bow with eccentrics of the shape illustrated by FIG. 10.

FIG. 10 illustrates an alternative eccentric 200 with a string track 201 resulting from rotating the track 193 180° with respect to the cable track 194. FIG. 11 plots the force draw curve 203 (F) and eccentric characteristics 204 (T), 205(B) and 206 (B/T), respectively, descriptive of a bow (FIG. 3) carrying eccentrics structured as illustrated by FIG. 10.

Figure 12:
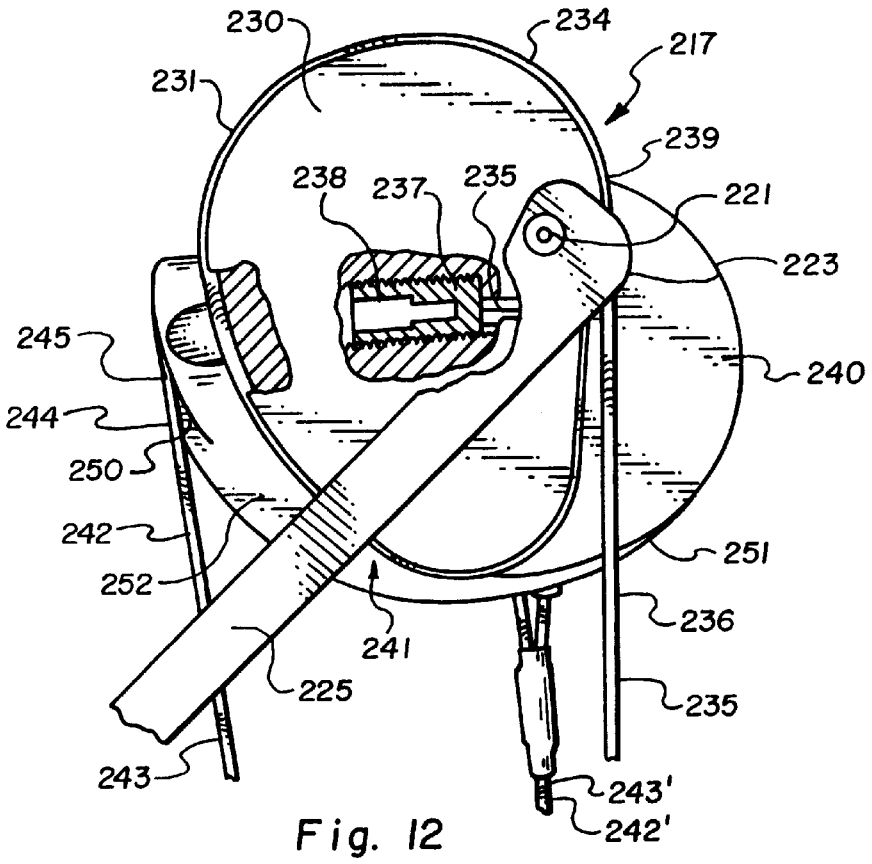
FIG. 12 is a view similar to FIG. 1 but showing an eccentric of the type disclosed by U.S. Pat. No. 4,686,955.
Figure 13:
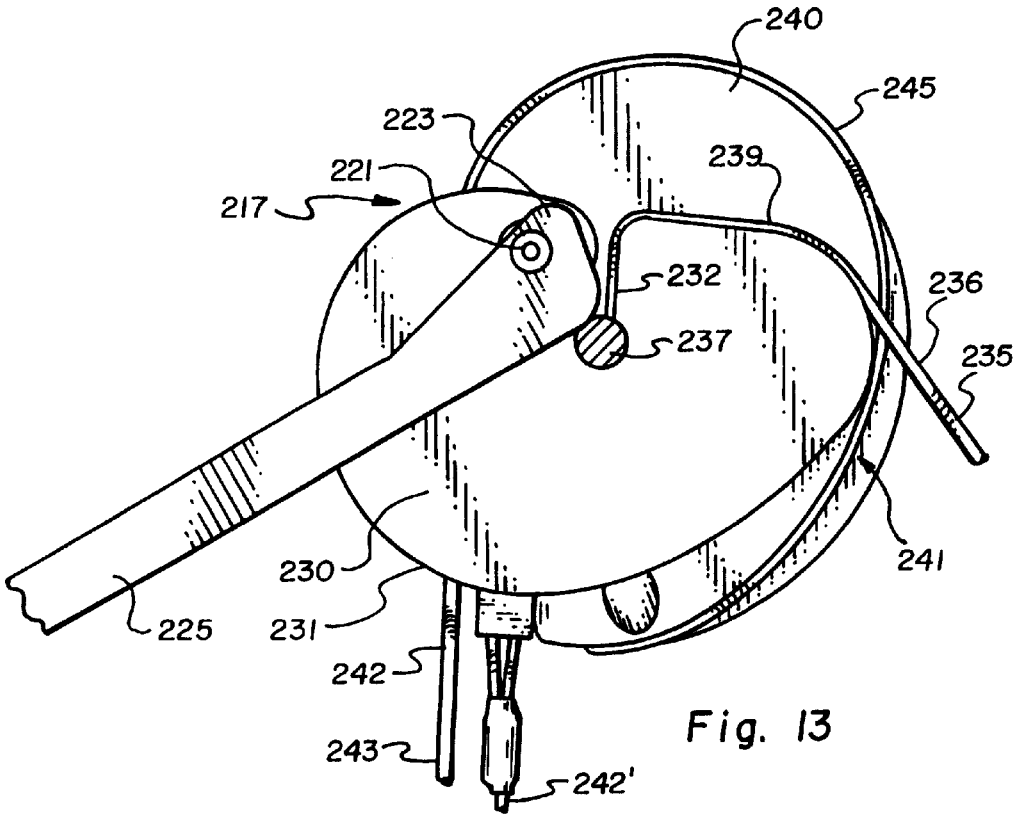
FIG. 13 is a view similar to FIG. 2 showing the eccentric of FIG. 12.

FIGS. 12 and 13 similarly represent an upper eccentric 217 of the type disclosed by parent U.S. Pat. No. 4,686,955. The corresponding lower eccentric is substantially similar except that it is reversed in configuration. Each eccentric is provided with a pivot hole which accommodates an axle 221 by which it is pivotally mounted to the distal end 223 of a limb 225.

Each eccentric 217 has a first sheave portion 230 with a peripheral bowstring track in the form of a string groove 231 communicating with an anchoring slot 232. A portion 234 of a bowstring 235 is wound around the sheave portion 230 in string groove 231, being held in place by the pressure of a large set screw 237 turned into a threaded bore 238. Comparing FIGS. 12 and 13, it is apparent that as the string 235 is pulled toward the archer, the eccentric 217 pivots around axle 221 from braced condition (FIG. 12) to drawn condition (FIG. 13). As the eccentric 217 pivots, the wound portion 234 of the string 235 unwinds from the string groove 231 and pays out as a lengthening of the central stretch 236 of the bow-string 235. The central stretch is measured from the point of tangency 239 of the bowstring 235 with the string groove 231. The location of this point continuously migrates during pivoting of the eccentric from braced condition (FIG. 12) to its eventual location 239 A at drawn condition (FIG. 13).

Each eccentric 217 additionally includes a second sheave portion 240 with a specialized cable track, designated generally 241. The tension run 242 begins at the anchoring point provided by the set screw 237. In braced condition, as shown by FIG. 12, most of the tension run 242 is unwound and forms an end stretch 243 extending from a point of tangency 244 with the cable track to a remote anchoring point (242' at the opposite limb). A relatively short portion 245 of the tension run 242 is stored in the cable track 241 between the point of tangency 244 and the set screw 237. FIG. 13 illustrates the eccentric 217 in drawn condition with the stored or wound portion 245 of the tension run 242 much lengthened, thereby reducing the length of the end stretch 243. The point of tangency (not visible) of the tension run 242 occurs approximately 270° of rotation removed from its original location, having migrated continuously around the cable track 241 from its initial position as the eccentric was pivoted from its braced condition.

The mechanical advantage of the rigging comprising the eccentrics 217 and cable loop comprising the bowstring 235 and tension runs 242, 242' is a function of, among other things, the cam ratio of the eccentrics. The cam ratio is determined by measuring the perpendicular distance between the axis of the axle 221 and the points of tangency 239 and 244. These perpendicular distances may be determined by direct measurement following well-known analytical geometry methods. The cam ratio may be defined as the "string distance" (221–239) divided by the "cable distance" (221–244). These distances are measured perpendicularly to the string and cable, respectively. Thus, as illustrated, this ratio is initially less than unity at braced condition and progressively increases in value to greater than unity at drawn condition. The rate of change of the cam ratio and its value at any degree of rotation with respect to its braced position is "programmed" by the shapes of the string track 231 and cable track 241 and their orientations with respect to each other.

The string track, as illustrated, may be regarded as defining a plane of intersection through the string groove 231, which is approximately normal and transverse the axis of the axle 221. The cable track 241 includes a braced cable groove 250 of relatively large effective radius, a drawn cable groove 251 of relatively small effective radius, and a step-down, take-up cable ramp 252 connecting the two cable grooves 250, 251. The cable track of this invention thus functions to move the tension run 242 down towards the axle 221 (thereby tending to increase the cam ratio of the eccentric near full drawn condition). The entire cable track 241 may be regarded as lying between parallel planes approximately parallel the plane of intersection of the string track 231, and may lie entirely in a plane parallel the string track.

Figure 14:
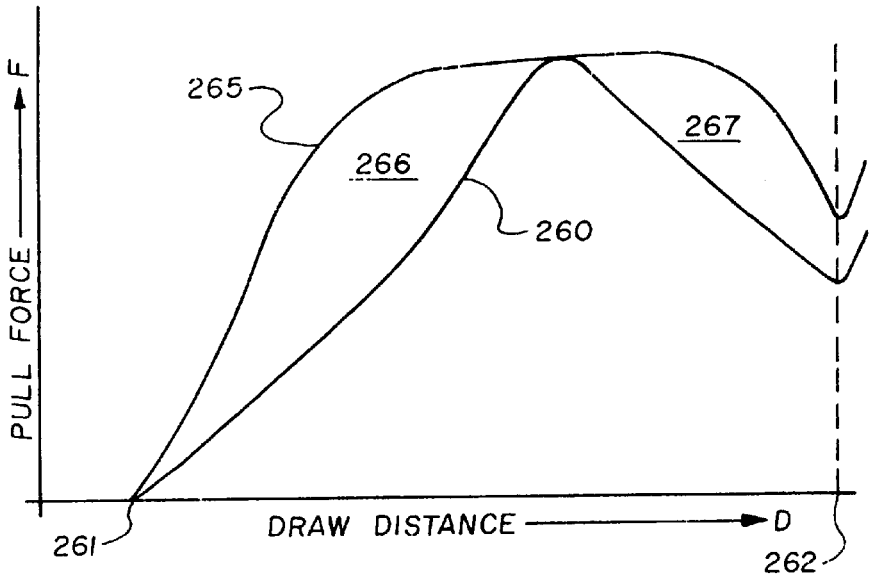
FIG. 14 is a graphical representation of a force draw curve characteristic of a bow similar to that illustrated by FIG. 3, but with eccentrics of the type illustrated by FIGS. 12 and 13, the curve being shown in comparison to a corresponding curve characteristic of circular eccentrics.

FIG. 14 illustrates graphically the practical advantage of this invention. It is recognized that the actual force draw curves of conventional compounds with circular eccentrics are widely variable and are generally not as disciplined as would appear from FIG. 14. Nevertheless, the curve 260 illustrated is representative of such bows. Assuming the eccentrics of the invention are substituted for the circular eccentrics of a prior art bow, and that the brace height and draw length are adjusted to be comparable to the prior art bow, it is possible to select configurations for the string track and tension run (cable) track (e.g. 231, 241, FIGS. 12 and 13) to generate a force draw curve with a similar percent let-off which stores considerably more available energy. The point 261 on FIG. 14 represents the distance at braced condition between a reference point at the handle 122 (FIG. 3) of the bow and the nocking point 158 of the bowstring. The point 262 represents the corresponding distance at full draw. The curves 260, 265 are plots of the pulling force (typically measured in pounds) required of an archer to hold the nocking point 158 at any drawn distance (typically measured in inches) between the points 261 and 262. It is generally understood by those skilled in the art that the area under the curves 260, 265 is an approximate representation (ignoring hysteresis losses) of the stored energy available for launching an arrow. The areas labeled 266 and 267 thus represent additional energy made available for this purpose by substituting the eccentrics of this invention for typical circular eccentrics of the prior art.

Figure 15:
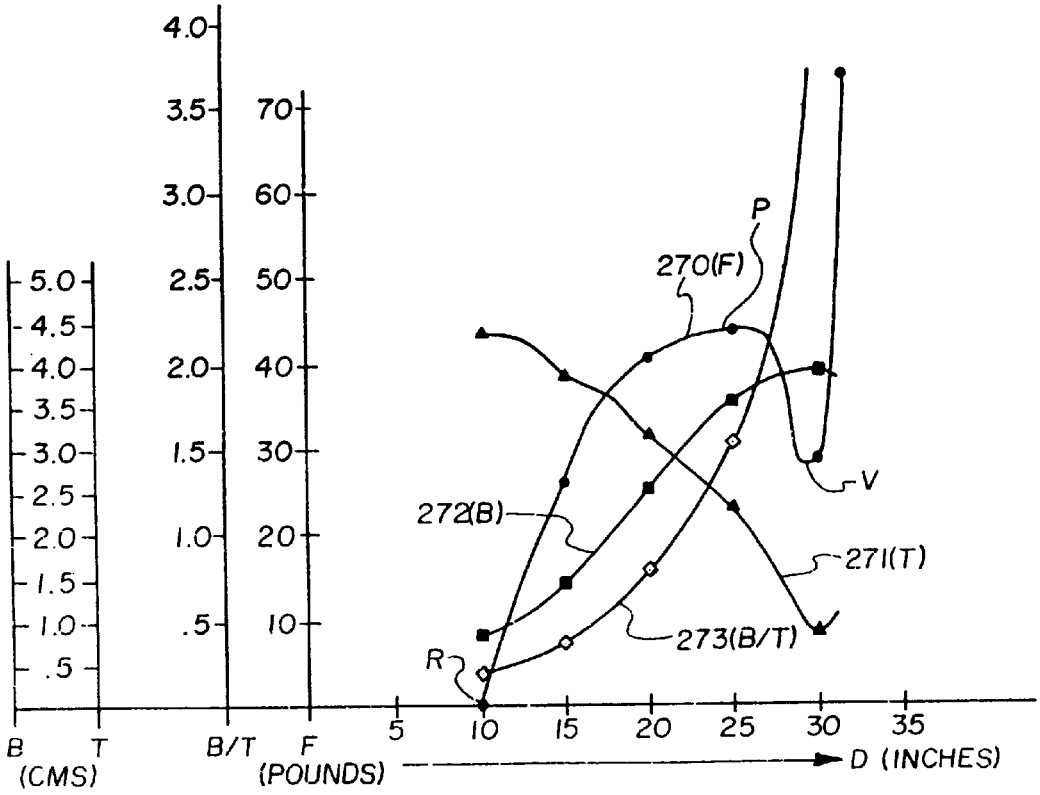
FIG. 15 is a graph similar to FIGS. 9 and 11 pertaining to a bow with eccentrics illustrated by FIGS. 12 and 13.
Figure 16:
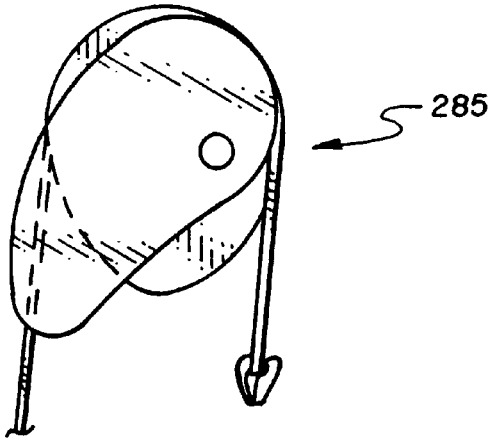
FIG. 16 is an alternative eccentric structure.
Figure 17:
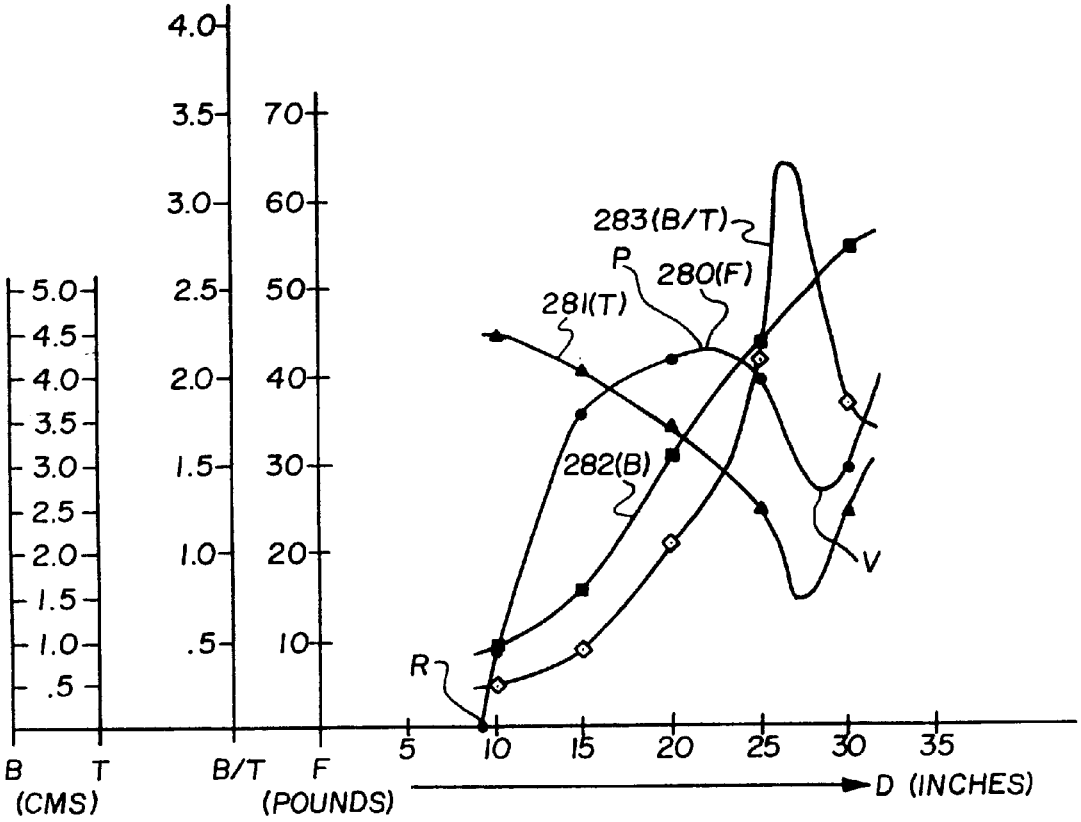
FIG. 17 is a graph similar to FIG. 15 pertaining to the eccentric of FIG. 16.

FIG. 15 is a graph reflecting the force draw curve 270 (F) of a bow constructed as illustrated by FIG. 3, but with an upper eccentric such as the eccentric 217 illustrated by FIGS. 12 and 13 and a lower eccentric with a configuration which is reversed compared to that of eccentric 217. Curves 271 (T), 272 (B), and 273 (B/T) plot the geometric characteristics of eccentrics 217 as a function of drawn distance so that those characteristics can be correlated to the force draw curve 270 in a fashion similar to the force draw curves and characteristics plotted on FIGS. 9 and 11. FIG. 16 is a similar graph with a force draw curve 280 and curves 281 (T), 282 (B) and 283 (B/T) as a function of draw distance for a similar bow with eccentrics 285 configured as shown.

In contrast to typical eccentrics of the prior art, the string track and tension run track of an eccentric of this invention are nonparallel and non-concentric. At least one, and preferably both, of the tracks are noncircular. In any event, the string track is substantially out of registration with the cable track. When both tracks are noncircular, they are oriented so that their major diameters are nonparallel. In any event, the cam ratio of the eccentrics of this invention in operation increases more rapidly during the initial stages of draw of the bowstring than does the cam ratio of a circular eccentric with parallel tracks corresponding to the string track 31 and tension run track 241.

The principal advantage of the eccentric structures illustrated by the drawings is the opportunity to program the cam ratio developed through a pivot cycle (as the bowstring is drawn and released to launch an arrow). The configuration of the string track and tension run track may be selected to produce a force draw curve with a very rapid rate of pull force increase as a function of incremental draw at the initial stages of draw, followed by prolonged, relatively constant pull force over the major portion of the draw of the bow, followed in turn by a rapid and substantial "let-off" or decrease in pulling force as the bowstring is pulled the last small increment to full draw.

FIGS. 9, 11, 15 and 16 plot eccentric characteristics as a function of draw. The geometry of an eccentric can thus be correlated to the force draw curve characteristic of a bow carrying those eccentrics. For purposes of this comparison, a bowstring lever arm B is defined as the distance between the center axis of an eccentric and the bowstring, measured normal the bowstring. A tension run (take-up cable) lever arm T is defined as the corresponding distance between the axis and the tension run, measured normal the tension run. These lever arms B, T, change in length as the eccentric rotates on its axis. The ratio B/T may be regarded as a cam ratio and is also plotted as a function of drawn distance. The shape of the force draw curve (F) characteristic of a bow is influenced by the course of the characteristic plots B and T as well as their respective magnitudes.

FIGS. 9, 11, 15 and 16 illustrate generally the characteristics of various compound bows with eccentrics comprising a wheel element (or pulley means) mounted to pivot on an axis at opposed limb tips and carrying a string groove with a geometric center removed from that axis. The string groove is ordinarily (but need not be) parallel a plane approximately normal the axis of rotation of the eccentric. The wheel element (pulley) also carries a take-up groove which is out of registration with the string groove about substantially the entire peripheries of the grooves As the nocking point 158 is displaced, the eccentrics rotate and the lever arm B changes as shown by plots 197 (FIG. 9), 205 (FIG. 11), 272 (FIG. 15) and 282 (FIG. 16) in correspondence to increases in draw force during a force-increasing phase of draw to a peak value P. Thereafter, the lever arm B increases very substantially. The lever arm B continues to increase with additional displacement D of the nocking point until let off occurs from peak force to a minimum "valley" V. The maximum lever arm value B occurs approximately at the draw distance D of minimum draw force V. To effect force draw curves characterized by very rapid initial increase in draw force, the maximum length of the lever arm B prior to occurrence of peak draw force P should be very small (typically less than ⅓, ideally less than about ⅕) compared to the maximum length of that arm B at the occurrence of minimum drawn force V. The ratio B/T is also significant to the shape of the force draw curve. To effect rapid increase in draw force from rest R to peak P, the value of B/T should remain small (less than unity, typically between about 1/10 and ⅓) during this portion of the draw, increasing rapidly thereafter by a factor of ten or more to values substantially above unity (up to 5 or more).

The following tables report the measured and calculated values plotted on FIGS. 9, 11, 15 and 16, respectively. "F" values are reported in pounds, "T" and "B" values are reported in centimeters (cms).

Figure 9

| D | 195 (F) | 196 (T) | 197 (B) | 198 (B/T) |
|---|---|---|---|---|
| 10 | 0 | 4.17 | 2.12 | 0.508 |
| 11 | 2.5 | 4.17 | 2.10 | 0.504 |
| 12 | 6.0 | 4.17 | 2.03 | 0.489 |
| 13 | 9.5 | 4.20 | 1.89 | 0.450 |
| 14 | 13.5 | 4.24 | 1.75 | 0.413 |
| 15 | 17.5 | 4.26 | 1.66 | 0.390 |
| 16 | 22.5 | 4.27 | 1.54 | 0.361 |
| 17 | 27.5 | 4.25 | 1.45 | 0.341 |
| 18 | 33.0 | 3.92 | 1.35 | 0.344 |
| 19 | 38.5 | 3.87 | 1.32 | 0.341 |
| 20 | 43.5 | 3.81 | 1.30 | 0.341 |
| 21 | 37.5 | 3.61 | 3.25 | 0.900 |
| 22 | 33.0 | 3.31 | 4.24 | 1.221 |
| 23 | 29.5 | 3.01 | 4.38 | 1.455 |
| 24 | 27.5 | 2.80 | 4.61 | 1.646 |
| 25 | 27.0 | 2.57 | 4.78 | 1.860 |
| 26 | 26.5 | 2.41 | 4.91 | 2.037 |
| 27 | 26.5 | 2.24 | 5.01 | 2.237 |
| 28 | 28.0 | 2.05 | 5.06 | 2.468 |
| 29 | 32.5 | 1.68 | 5.03 | 2.994 |
| 30 | 41.5 | 1.52 | 4.41 | 2.901 |

Figure 11

| D | 203 (F) | 204 (T) | 205 (B) | 206 (B/T) |
|---|---|---|---|---|

-continued

| | | | | |
|---|---|---|---|---|
| 10 | 0 | 4.25 | 1.31 | 0.308 |
| 11 | 3.0 | 4.25 | 1.28 | 0.301 |
| 12 | 8.0 | 4.25 | 1.31 | 0.308 |
| 13 | 13.0 | 4.25 | I.31 | 0.308 |
| 14 | 17.5 | 4.22 | 1.31 | 0.310 |
| 15 | 22.5 | 4.22 | 1.33 | 0.315 |
| 16 | 27.0 | 4.20 | 1.35 | 0.321 |
| 17 | 32.0 | 4.00 | 1.35 | 0.338 |
| 18 | 36.0 | 3.88 | 1.40 | 0.36I |
| 19 | 39.5 | 3.73 | 1.50 | 0.402 |
| 20 | 41.0 | 3.50 | 1.69 | 0.483 |
| 21 | 42.0 | 3.31 | 1.96 | 0.592 |
| 22 | 43.0 | 3.04 | 2.18 | 0.717 |
| 23 | 43.0 | 2.51 | 2.39 | 0.952 |
| 24 | 42.0 | 2.22 | 2.55 | 1.149 |
| 25 | 37.0 | 1.96 | 3.30 | 1.684 |
| 26 | 29.5 | 1.64 | 4.32 | 3.634 |
| 27 | 26.0 | 1.49 | 4.71 | 3.161 |
| 28 | 25.0 | 1.49 | 4.93 | 3.309 |
| 29 | 26.0 | 1.49 | 5.02 | 3.369 |

Figure 15

| D | 270 (F) | 271 (T) | 272 (B) | 273 (B/T) |
|---|---|---|---|---|
| 9 | 0 | 4.31 | 0.84 | 0.195 |
| 10 | 0 | 4.33 | 0.84 | 0.194 |
| 11 | 7.0 | 4.33 | 0.88 | 0.203 |
| 12 | 12.5 | 4.33 | 0.97 | 0.224 |
| 13 | 17.0 | 4.17 | 1.11 | 0.266 |
| 14 | 22.0 | 4.03 | 1.33 | 0.330 |
| 15 | 26.0 | 3.89 | 1.45 | 0.373 |
| 16 | 30 | 3.84 | 1.63 | 0.424 |
| 17 | 34.0 | 3.78 | 1.83 | 0.484 |
| 18 | 37.5 | 3.60 | 2.01 | 0.558 |
| 19 | 40.0 | 3.35 | 2.23 | 0.666 |
| 20 | 41.0 | 3.17 | 2.53 | 0.798 |
| 21 | 42.0 | 2.95 | 2.78 | 0.942 |
| 22 | 43.0 | 2.80 | 3.00 | 1.071 |
| 23 | 43.5 | 2.63 | 3.20 | 1.213 |
| 24 | 43.5 | 2.46 | 3.39 | 1.378 |
| 25 | 43.5 | 2.30 | 3.53 | 1.535 |
| 26 | 44.0 | 2.05 | 3.58 | 1.746 |
| 27 | 43.0 | 1.71 | 3.68 | 2.152 |
| 28 | 39.0 | 1.49 | 3.79 | 2.544 |
| 29 | 28.0 | 1.12 | 3.93 | 3.509 |
| 30 | 28.5 | 0.82 | 3.93 | 4.793 |
| 31 | 29.0 | 0.87 | 3.93 | 4.517 |
| 32 | 74.0 | 1.05 | 3.86 | 3.676 |

Figure 16

| D | 280 (F) | 281 (T) | 282 (B) | 283 (B/T) |
|---|---|---|---|---|
| 9 | 0 | 4.49 | 0.98 | .218 |
| 10 | 8.5 | 4.46 | 0.98 | .220 |
| 11 | 15.5 | 4.44 | 1.02 | .230 |
| 12 | 22.0 | 4.39 | 1.14 | .260 |
| 13 | 27.5 | 4.35 | 1.25 | .287 |
| 14 | 32.0 | 4.20 | 1.39 | .331 |
| 15 | 35.5 | 4.04 | 1.57 | .389 |
| 16 | 38.0 | 3.86 | 1.82 | .474 |
| 17 | 39.5 | 3.74 | 2.11 | .564 |
| 18 | 40.5 | 3.61 | 2.43 | .673 |
| 19 | 41.0 | 3.55 | 2.79 | .786 |
| 20 | 41.5 | 3.46 | 3.08 | .890 |
| 21 | 42.0 | 3.29 | 3.42 | 1.040 |
| 22 | 42.5 | 3.16 | 3.69 | 1.168 |
| 23 | 42.0 | 2.99 | 3.93 | 1.314 |
| 24 | 41.5 | 2.80 | 4.16 | 1.486 |
| 25 | 39.5 | 2.49 | 4.35 | 1&747 |
| 26 | 35.0 | 2.06 | 4.49 | 2.180 |
| 27 | 30.0 | 1.42 | 4.61 | 3.246 |
| 28 | 27.0 | 1.56 | 4.84 | 3.103 |
| 29 | 27.0 | 2.00 | 5.17 | 2.585 |
| 30 | 29.5 | 2.48 | 5.48 | 2.210 |
| 30.5 | 33.5 | 3.00 | 5.54 | 1.847 |
| 31 | 35.0 | 3.00 | 5.55 | 1.850 |

-continued

| | | | | |
|---|---|---|---|---|
| 31.5 | 40.0 | 3.00 | 5.57 | 1.857 |
| 32 | 60.0+ | 3.32 | 5.57 | 1.678 |

From the tabulated data and the force draw curves of FIGS. 11, 15 and 16, it is apparent that, for practical purposes, the holding force F developed by typical bows of this invention remains substantially constant at a near peak value P during a major portion of the draw. Referring to FIG. 16, for example, maximum draw force is substantially achieved when the nocking point is moved a distance of approximately 6 inches (from a 9-inch braced position to a 15-inch draw distance). The holding force then remains substantially constant for an additional approximately 9 inches of draw, after which it falls off rapidly to a minimum within an additional 4 inches of draw.

Rotation of the eccentrics is inherently related to the cam ratio of the eccentrics and deflection of the limb tips. Typically, eccentrics rotate approximately ¾ of a full turn on their axes as the nocking point of the bowstring is pulled from rest R to full drawn (approximately V) position. This rotation, while linearly related to the distance D that the nocking point 158 is displaced, is not directly proportional to that distance. The percentage of actual rotation of an eccentric is inevitably less than the percentage of nocking point displacement for all drawn distances between rest and full draw. Thus, an approximation (which will always be high) of eccentric rotation (from its orientation at rest) at any drawn position can be calculated by dividing the inches of nocking point displacement of that position by the total draw distance between rest (R) and full draw (V) positions of the nocking point.

Figure 18A:
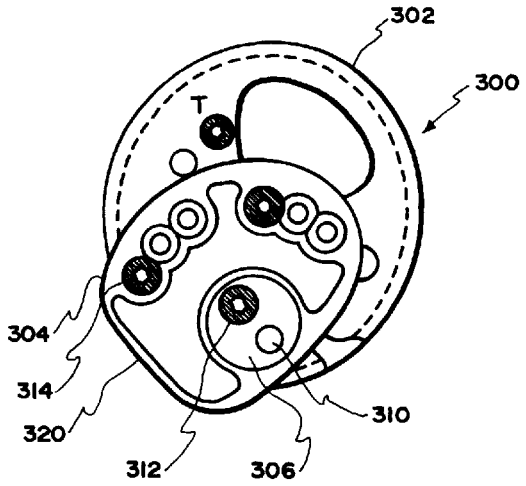
FIG. 18 is a two-part drawing, FIGS. 18*a* and 18*b*, respectively, showing opposite sides of a preferred eccentric element of this invention adjusted to a short pull configuration.
Figure 18B:
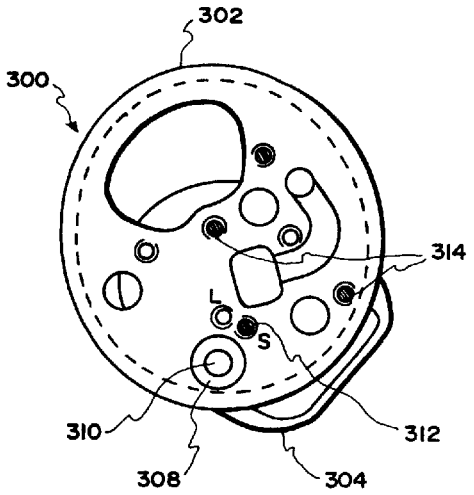
Figure 19A:
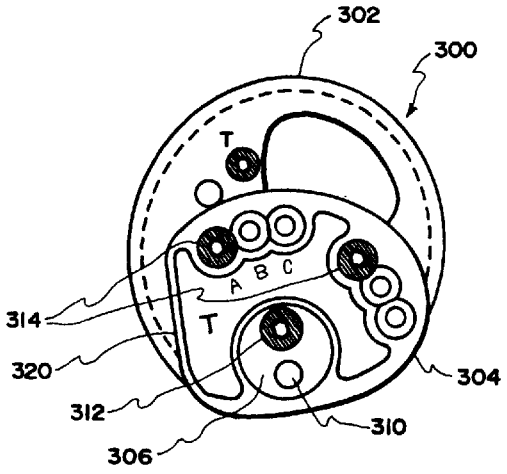
FIG. 19 is a two-part drawing, FIGS. 19*a* and 19*b*, respectively, showing opposite sides of the eccentric element of FIG. 18, but adjusted to a long pull configuration.
Figure 19B:
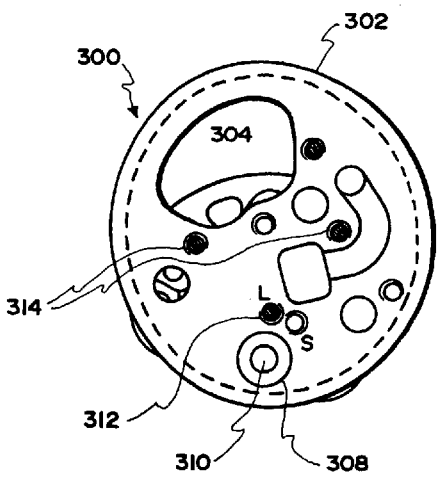

Referring to FIGS. 18 and 19, a highly preferred eccentric of this invention, designated generally 300, includes a first sheave 302 and a second sheave 304. The illustrated eccentrics for the top limb of a left handed bow, as noted by the markings "T" and "L." Eccentrics for the bottom limb, in the illustrated instance, are mirror image constructions of the upper eccentric. Eccentrics for right handed bows merely reverse the sides occupied by the respective sheaves 302, 304. For convenience, the second sheave 304 may be referred to as an "inner cam." It is shown rotatably joined to the first sheave 302 through a rotatable hub 306 in the manner described by the aforementioned U.S. Pat. Nos. 4,686,955 and 4,774,927. The hub 306 is itself rotatably mounted with respect to one of the sheaves 302, 304, thereby lending an additional degree of freedom to the assembly. As shown, it pivots on a bushing 308 fixed with respect to the sheave 302. The hollow interior 310 of the bushing 308 defines a pivot hole for mounting the eccentric 300 to an axle. Thus, the axis of rotation for the eccentric is congruent with the axis of the bushing 308. The hub 306 can be moved between a first, "short draw" position (FIG. 18) or a second, "long draw" position (FIG. 19), being secured in either case by a flat head screw 312. With the hub 306 in either of its illustrated positions, the inner cam 304 may be rotated to any selected one of the positions "A," "B," or "C," being secured by a pair of flat head screws 314. Other embodiments may provide pivoted positions in addition to the "L," "S," "A," "B" and "C" positions illustrated.

Figure 20:
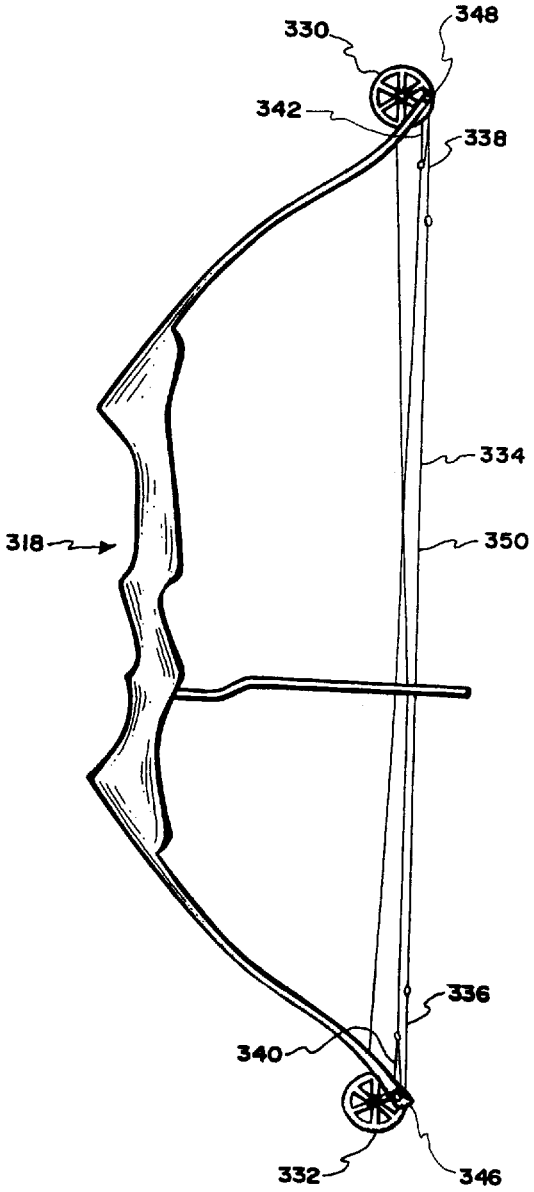
FIG. 20 is a pictorial view of a compound bow rigged with eccentrics of the type illustrated by FIGS. 18 and 19.
Figure 21:
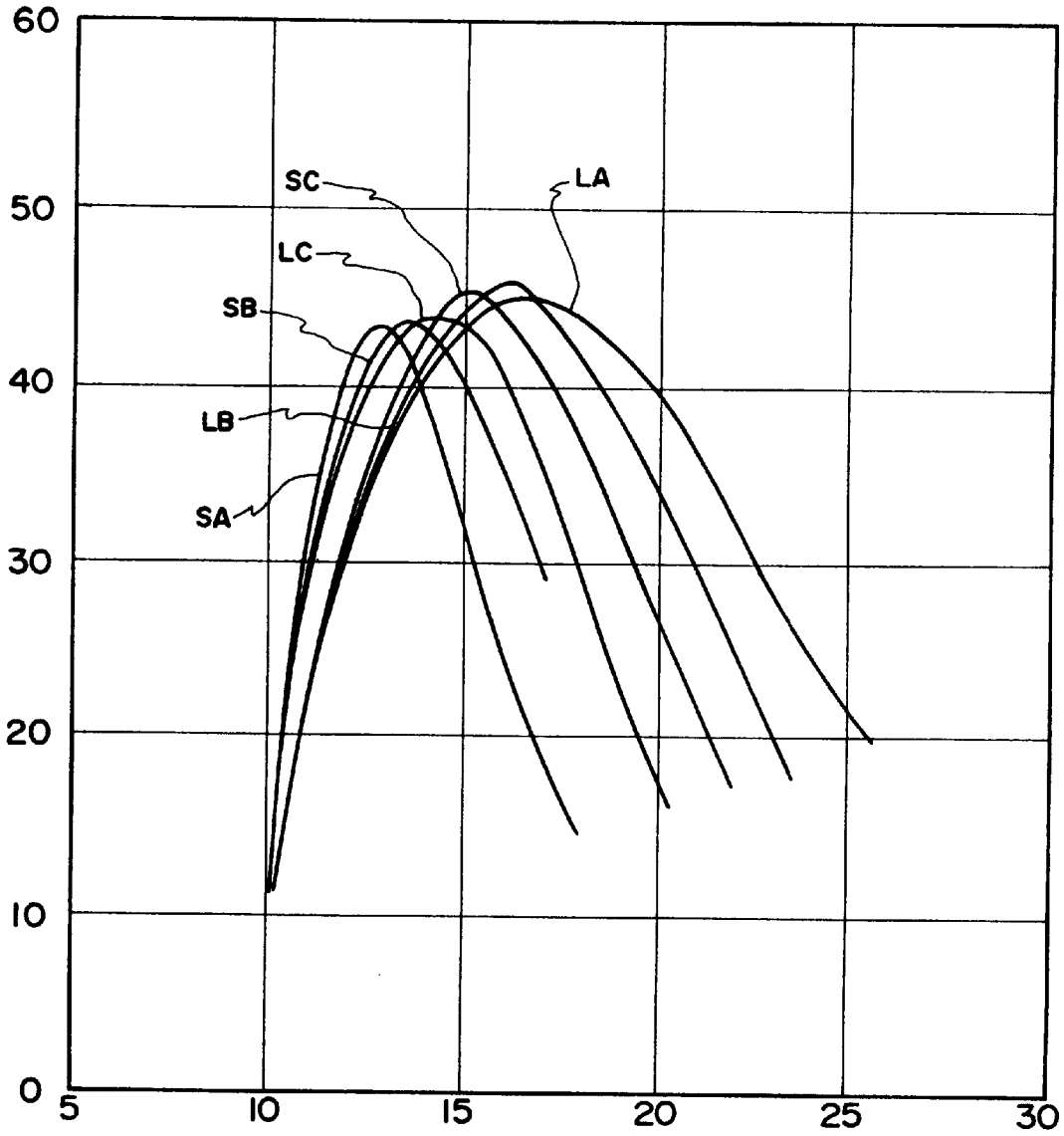
FIG. 21 is a graphical representation of a force draw curves of a bow similar to that illustrated by FIG. 3 with eccentrics as illustrated by FIGS. 18 and 19 set at various adjustments.

The eccentrics of FIGS. 18 and 19 may be mounted in a compound bow assembly, generally 318, as illustrated by FIG. 20 to effect force draw curves generally as illustrated by FIG. 21. The upper wheel 330 is an eccentric member constructed as the mirror image of the lower wheel 332. A central stretch 334 extends between a pair of end stretches 336, 338, each of which is trained around a respective wheel, and then anchored at opposite respective ends 340, 342 to opposing limb tips 346, 348. The pulling force required to move the nocking point 350 from the illustrated at rest condition of the bow 318 through an intermediate peak holding force position to a fully drawn condition is shown by FIG. 21 for several configurations of the eccentric wheels 330, 332. As illustrated, the force draw curve labeled "SA" is developed when the eccentrics are configured as illustrated by FIG. 18. The force draw curve labeled "LA" is developed when the eccentrics are configured as illustrated by FIG. 19. The other curves are developed with the screws 312 in the positions indicated either "S" or "L," and the screws 314 in the positions indicated either "B" or "C." This eccentric is constructed to effect a let off of approximately 55–70%, depending upon the configuration selected, as the cable winds onto the surface 320. The following table reports the data from which the curves of FIG. 21 are plotted.

| | Figure 21 | | | | | |
|---|---|---|---|---|---|---|
| | LA | LB | LC | SA | SB | SC |
| 10 | 10 | 10½ | 9½ | 12½ | 14 | 16½ |
| 11 | 20½ | 21½ | 21 | 25 | 27½ | 29½ |
| 12 | 30½ | 30 | 30½ | 30½ | 36½ | 39½ |
| 13 | 36 | 37 | 38 | 42 | 42½ | 44 |
| 14 | 40½ | 41½ | 44 | 45 | 45 | 42½ |
| 15 | 43 | 44½ | 45 | 44½ | 41½ | 36½ |
| 16 | 44½ | 45 | 44 | 41½ | 35½ | 28½ |
| 17 | 45 | 44½ | 42 | 36½ | 29½ | 21 |
| 18 | 44½ | 42 | 38 | 31 | 22 | 15½ |
| 19 | 42½ | 39 | 33 | 25 | 16½ | |
| 20 | 40 | 34 | 27 | 18½ | 14½ | |
| 21 | 36½ | 29½ | 21½ | 15 | | |
| 22 | 32 | 24 | 17 | | | |
| 23 | 27 | 18 | | | | |
| 24 | 22 | 17½ | | | | |
| 25 | 20½ | | | | | |
| Draw Length | 25" | 24" | 22¾" | 21¾" | 20½" | 18⅞" |
| Draw Weight | 45 | 45 | 45 | 45 | 45 | 45 |
| Ho1ding Weight | 20½ | 17½ | 16½ | 15 | 14½ | 15½ |
| Speed (FPS-540 Gr.) | 163 | 155 | 146 | 137 | 127 | 116 |
| Let Off % | 55% | 62% | 63% | 67% | 68% | 66% |

Figure 22:
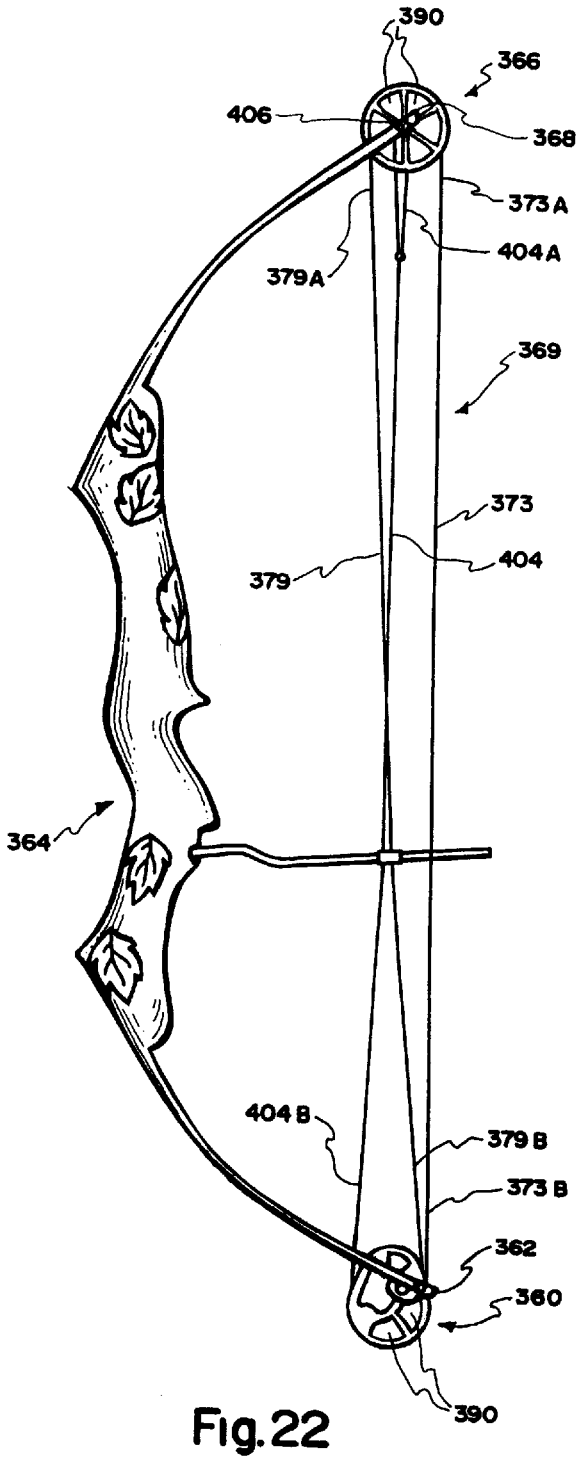
FIG. 22 illustrates a compound bow rigged to include a single eccentric of this invention in an arrangement with a dissimilar pulley element.

FIG. 22 illustrates an embodiment which is sometimes referenced to as a "single cam bow," indicating that the force draw curve characteristics are influenced primarily by a single eccentric 360 of this invention, shown mounted on the lower limb tip 362 of an assembled bow 364. The wheel 366 mounted at the opposite limb tip 368 is often referred to as an "idler." Bows of this type may be structured and rigged substantially as illustrated by any of U.S. Pat. Nos. 5,368, 369,006; 4,365,611 or the patent application of Larry D. Miller entitled "Archery Bow Assembly" made of record in the prosecution file of the '006 patent. The disclosures of these patents and the application are incorporated by reference as a part of this disclosure for their explanation of the construction and operation of compound bows carrying dissimilar wheel elements at opposing limb tips.

The unique step-down take-up ramp of this invention may be incorporated variously in the wheel elements of dual-feed single-cam compound bows in which a single "drop off" cam with peripheral eccentric grooves is journaled at the tip of a first limb and an idler pulley is concentrically (or in some cases concentrically) journaled at the tip of a second opposing limb. The idler pulley may have one or more grooves concentric with the axis of rotation of the pulley. Rigging in the form of an elongated cable or cable segments interconnects the cam, the idler and the limb tips. For example, an intermediate portion may be trained around the idler to form two stretches extending to the cam. One of those stretches may form a bowstring with feed out portions at its opposite ends. The other stretch may form a take up portion at the end contacting the idler and a feed out portion at the end in contact with the cam. Both stretches thus Include feed out portions received in eccentric peripheral grooves of the cam to present a pair of feed out sections extending towards the idler. The ends of both stretches may be positively anchored to the cam in a fashion to provide the desired drop off as the bowstring is pulled to full draw. According to certain embodiments, an anchor cable may extend between the limbs with one end fixed at the limb tip supporting the idler and the other end fixed to the cam and trained in a take-up groove of the cam to produce controlled flexing of the limbs as the bowstring is pulled.

The wheel 360 may carry string and cable grooves configured with respect to each other as disclosed in connection with any of FIGS. 1, 8, 10, 12, 16, or 18, for example. The wheel 366 may be a substantially concentric pulley member, but preferably includes eccentric string and cable grooves to assist in the creation of desired force-draw characteristics for the bow. The specific rigging arrangement, generally 369, preferred for a single cam bow of the type illustrated by FIG. 22 differs from other designs in that the central stretch or bowstring portion of the rigging may be terminated at both the upper and lower wheels. Thus, the central stretch portion may be fashioned of material preferred for use as a bowstring, but not as suitable for the remainder of the rigging. A relatively shorter length of string material, typically 61 inches, may be replaced as it wears without disturbing the remainder of the rigging. The end stretch portions of the rigging are preferably of more durable material, such as air craft cable.

Figure 23A:
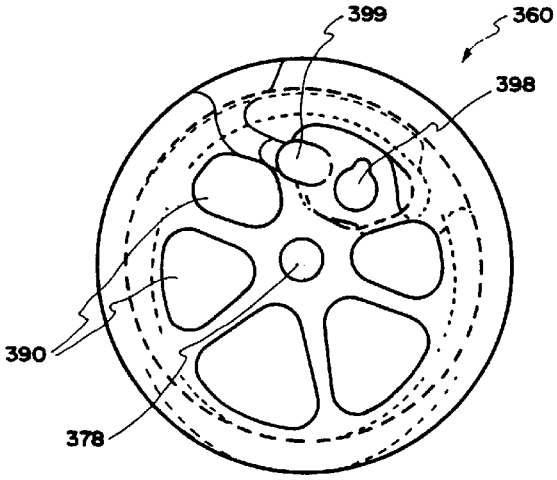
FIG. 23 is a two-part drawing, FIG. 23*a* being a view in plan view, with hidden surfaces shown in phantom lines, and FIG. 23*b* being a view in side elevation, of an idler wheel useful in the bow illustrated by FIG. 22.
Figure 23B:
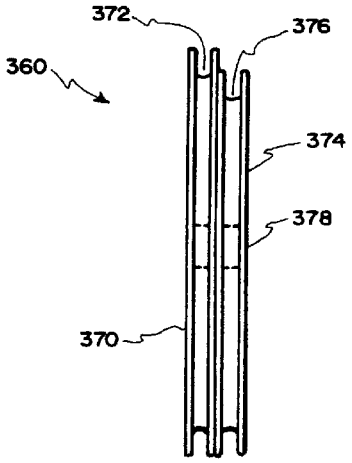
Figure 24:
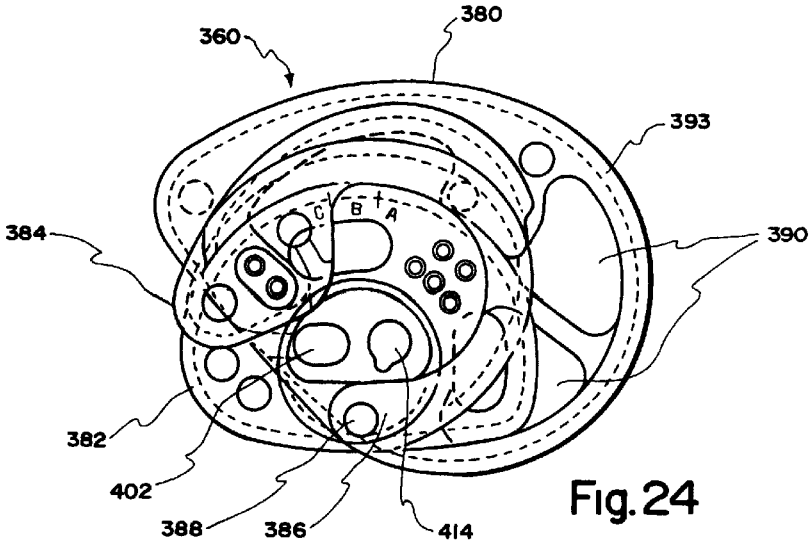
FIG. 24 is a plan view, with hidden surfaces shown in phantom lines, of an assembled cam wheel useful in the bow construction of FIG. 22.
Figure 25A:
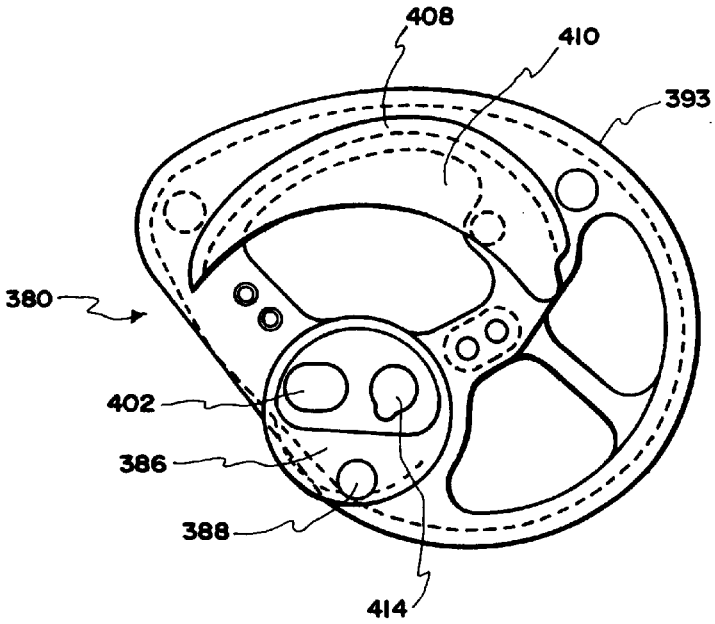
FIG. 25 is a three-part drawing showing in FIGS. 25*a, b* and *c,* respectively, the principal components of the assembly illustrated by FIG. 24.
Figure 25B:
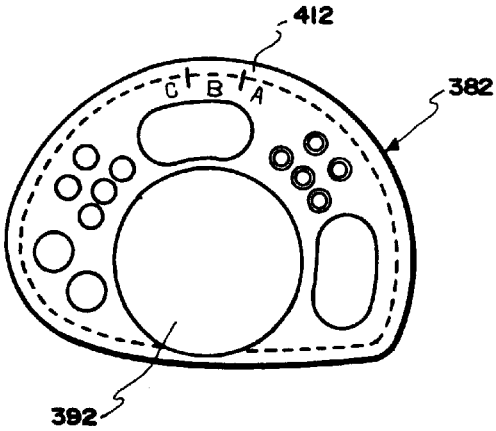
Figure 25C:
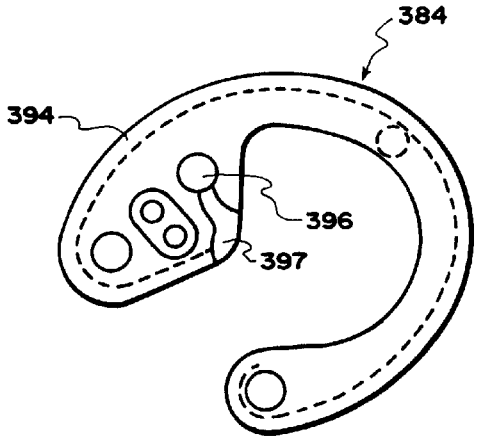

FIG. 23 illustrates an idler wheel 366 having a first sheave 370 with a slightly eccentric peripheral groove 372 which constitutes a feed-out string groove for the idler end 373A of the central or string stretch 373 of the rigging 369. A second sheave 374 has a peripheral groove 376 of somewhat greater eccentricity with respect to the pivot hole 378 which functions as a take-up groove for the idler end 379A of a first cable stretch 379. FIG. 24 illustrates a cam 360 with three sheaves 380, 382 and 384, each shown separately in FIGS. 25*a, b* and *c,* respectively. The sheave 380 serves as a structural support for assembly of the cam 360. It includes a hub 386 with a pivot hole 388. The orientation of the cam 360 and idler 366 mounted on the bow 364 (FIG. 22) in its rest condition can be correlated to FIGS. 23–25 by reference to the individually shaped lightening holes 390 in each of the wheels.

The "inner cam" sheave 382 contains a central aperture 392 which fits over the hub 386. A "half cam" 384 also fits over the hub 386, and is fastened atop the inner cam 382 as best shown by FIG. 24. The assembled cam 360 thus presents a larger peripheral string groove 393 which functions as a feed-out groove for the cam end 373B of the bowstring 373. The cam end 379B of the cable segment 379 is trained around a peripheral feed-out groove 394, its terminus being anchored in the hole 396 and passage 397. The terminus of the idler end 379A is anchored at the hole 398 (FIG. 23A). The terminus of the idler end 373A of the string 373 is anchored in the hole 399, while the terminus of the cam end 373B is anchored at the hole 402 of the hub 386. The terminus of the idler end 404A of the second cable stretch 404 is anchored to the limb tip 368, preferably at the axle 406 as illustrated. The cam end 404B of the second cable stretch 404 is trained around the peripheral groove 408 of the segment 410 of the sheave 380, and then around the peripheral groove 412 of the sheave 382, being anchored at the hole 414 in the hub 386. The sheave, or inner cam 382 is rotatable on the hub 386, as disclosed in connection with other embodiments so that the grooves 408 and 412 together constitute a take-up "working track." This working track is adjustable to effect the force-draw characteristics of the bow.

The preferred single cam construction of this invention thus includes two distinctly different wheels interconnected by three stretches. Each stretch may be separately replaced as needed, being independently anchored at each end. The idler wheel presents two tracks, each of which is preferably eccentric with respect to the pivot axis 378. The cam wheel presents three tracks, two of which pay out cable, while the inner cam functions as a "power cam" to shape the force-draw curve produced by operation of the bow.

Reference herein to certain details of the illustrated embodiments is not intended to limit the scope of the appended claims which themselves recite those features of the invention regarded as significant.

What is claimed is:

1. In combination, a compound archery bow and an idler for a compound archery bow, comprising:

a compound archery bow;

an idler body having a circularly shaped periphery;

a central aperture formed in the idler body, the central aperture being concentric with respect to the periphery and providing a pivot axis for the idler;

a first groove formed in the periphery of the idler;

a second groove formed in the periphery of the idler;

wherein at least one of the first groove or the second groove is concentric with respect to the central aperture wherein the first groove is configured differently as compared to the second groove.

2. An idler for a compound archery bow, comprising:

an idler body;

a circularly shaped periphery;

a central aperture formed in the idler body, the central aperture being concentric with respect to the periphery and providing a pivot axis for the idler;

a first groove formed in the periphery of the idler;

a second groove formed in the periphery of the idler;

wherein at least one of the first groove or the second groove is concentric with respect to the central aperture;

wherein the first groove is spaced differentially with respect to the second groove at different radial locations about the periphery of the idler body.

3. An idler for a compound archery bow, comprising:

an idler body;

a circularly shaped periphery;

a central aperture formed in the idler body, the central aperture being concentric with respect to the periphery and providing a pivot axis for the idler;

a first groove formed in the periphery of the idler;

a second groove formed in the periphery of the idler;

wherein at least one of the first groove or the second groove is concentric with respect to the central aperture;

further comprising a first anchor location provided on a first plane slide of the idler and a second anchor location provided on a second plane side of the idler.

4. In combination, a compound archery bow and an idler for a compound archery bow, comprising:

a compound archery bow;

an idler body having a circularly shaped periphery;

a central aperture formed in the idler body, the central aperture being concentric with respect to the periphery and providing a pivot axis for the idler;

a pair of grooves formed in the periphery of the idler;

wherein the grooves have different configurations relative to one another and wherein at least one of the grooves is concentric with the central aperture.

5. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein the grooves have different configurations relative to one another and wherein at least one of the grooves is concentric with the central aperture;

wherein the pair of grooves are spaced differentially with respect to each other at different radial locations about the periphery of the idler body.

6. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein the grooves have different configurations relative to one another and wherein at least one of the grooves is concentric with the central aperture;

further comprising a first anchor location provided on a first plane side of the idler and a second anchor location provided on a second plane side of the idler.

7. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein the grooves have different configurations relative to one another and wherein at least one of the grooves is concentric with the central aperture;

wherein the pair of grooves extend radially outwardly to the periphery of the idler body and terminate at a common location at one area on the periphery of the idler body.

8. In combination, a compound archery bow and an idler for a compound archery bow, comprising:

a compound archery bow;

an idler body having a circularly shaped periphery;

a central aperture formed in the idler body, the central aperture being concentric with respect to the periphery and providing a pivot axis for the idler;

a pair of grooves formed in the periphery of the idler;

wherein at least one of the grooves is concentric with respect to the central aperture;

wherein at least one groove is out of registration with respect to the other.

9. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein at least one of the grooves is concentric with respect to the central aperture;

wherein at least one groove is out of registration with respect to the other;

wherein the pair of grooves are spaced differentially with respect to each other at difficult radial locations about the periphery of the idler body.

10. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein at least one of the grooves is concentric with respect to the central aperture;

wherein at least one groove is out of registration with respect to the other;

further comprising a first anchor location provided on a first plane side of the idler and a second anchor location provided on a second plane side of the idler.

11. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein at least one of the grooves is concentric with respect to the central aperture;

wherein at least one groove is out of registration with respect to the other;

wherein the pair of grooves extend radially outwardly to the periphery of the idler body and terminate at a common location at one area on the periphery of the idler body.

12. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein the grooves have different configurations relative to one another and wherein at least one of the grooves is eccentric with respect to the central aperture.

13. An idler for a compound archery bow according to claim 12 wherein the pair of grooves are spaced differentially with respect to each other at difficult radial locations about the periphery of the idler body.

14. An idler for a compound archery bow according to claim 12, further comprising a first anchor location provided on a first plane slide of the idler and a second anchor location provided on a second plane side of the idler.

15. An idler for a compound archery bow according to claim 12 wherein the pair of grooves extend radially outwardly to the periphery of the idler body and terminate at a common location at one area on the periphery of the idler body.

16. An idler for a compound archery bow comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein the grooves are configured differently with respect to one another;

wherein the configuration of the respective grooves results in the idler body being unbalanced as the idler body rotates about the central aperture.

17. An idler for a compound archery bow according to claim 16 wherein the pair of grooves are spaced differentially with respect to each other at difficult radial locations about the periphery of the idler body.

18. An idler for a compound archery bow according to claim 16, further comprising a first anchor location provided on a first plane slide of the idler and a second anchor location provided on a second plane side of the idler.

19. An idler for a compound archery bow according to claim 16 wherein the pair of grooves extend radially outwardly to the periphery of the idler body and terminate at a common location at one area on the periphery of the idler body.

20. An idler for a compound archery bow, comprising:

an idler body;

a circularly shaped periphery;

a central aperture formed in the idler body, the central aperture being concentric with respect to the periphery and providing a pivot axis for the idler;

a pair of grooves formed in the periphery of the idler;

wherein the grooves are configured differently with respect to one another;

wherein the configuration of the respective grooves results in differential mass of the idler in segments of the idler body extending radially outwardly from the central aperture.

21. An idler for a compound archery bow according to claim 20 wherein the pair of grooves are spaced differentially with respect to each other at difficult radial locations about the periphery of the idler body.

22. An idler for a compound archery bow according to claim 20, further comprising a first anchor location provided on a first plane slide of the idler and a second anchor location provided on a second plane side of the idler.

23. An idler for a compound archery bow according to claim 20 wherein the pair of grooves extend radially outwardly to the periphery of the idler body and terminate at a common location at one area on the periphery of the idler body.

24. An idler for a compound archery bow, comprising:

an idler body having a first side and a second side;

a circularly shaped periphery;

a central aperture formed in the idler body, the central aperture being concentric with respect to the periphery and providing a pivot axis for the idler;

a first groove formed in the periphery of the idler;

a second groove formed in the periphery of the idler;

a first anchor location provided on the first side of the idler;

a second anchor location provided on the second side of the idler.

25. An idler for a compound archery bow according to claim 24 wherein the first groove is spaced differentially with respect to the second groove at different radial locations about the periphery of the idler body.

26. An idler for a compound archery bow comprising:

an idler body;

a circularly shaped periphery;

a central aperture formed in the idler body, the central aperture being concentric with respect to the periphery and providing a pivot axis for the idler;

a first groove formed in the periphery of the idler;

a second groove formed in the periphery of the idler;

the first groove and the second groove configured to create a weight differential at different locations about the periphery of the idler.

27. An idler for a compound archery bow according to claim 26 wherein the first groove is spaced differentially with respect to the second groove at different radial locations about the periphery of the idler body.

28. An idler for a compound archery bow according to claim 26, further comprising a first anchor location provided on a first plane slide of the idler and a second anchor location provided on a second plane side of the idler.

29. An idler for a compound archery bow, comprising:

an idler body;

a circularly shaped periphery:

a central aperture formed in the idler body, the central aperture,being concentric with respect to the periphery and providing a pivot axis for the idler;

a first groove formed in the periphery of the idler;

a second groove formed in the periphery of the idler;

the first groove and the second groove configured such that the idler is unbalanced with respect to structural segments extending radially outwardly from the central aperture to various points about the periphery of the idler.

30. An idler for a compound archery bow comprising:

an idler body having a first side and a second side;

a circularly shaped periphery;

a central aperture formed in the idler body, the central aperture being concentric with respect to the periphery and providing a pivot axis for the idler;

a first groove formed in the periphery of the idler;

a second groove formed in the periphery of the idler;

a first anchor location provided on the first side of the idler;

a second anchor location provided on the second side of the idler;

the first groove and the second groove configured to create an unbalanced idler.

* * * * *